US010475603B2

(12) United States Patent
Wilkins et al.

(10) Patent No.: US 10,475,603 B2
(45) Date of Patent: Nov. 12, 2019

(54) SINGLE THROW BATTERY SWITCH WITH IMPROVED CONTACT DOME

(71) Applicant: Power Products, LLC, Menomonee Falls, WI (US)

(72) Inventors: Christopher Wilkins, Kaeo (NZ); Christopher Paul Chambers, Auckland (NZ)

(73) Assignee: Power Products, LLC, Menomonee Falls, WI (US)

( * ) Notice: Subject to any disclaimer, the term of this patent is extended or adjusted under 35 U.S.C. 154(b) by 0 days.

(21) Appl. No.: 15/526,612

(22) PCT Filed: Nov. 13, 2015

(86) PCT No.: PCT/US2015/060528
§ 371 (c)(1),
(2) Date: May 12, 2017

(87) PCT Pub. No.: WO2016/077668
PCT Pub. Date: May 19, 2016

(65) Prior Publication Data

US 2017/0338066 A1 Nov. 23, 2017

Related U.S. Application Data

(60) Provisional application No. 62/080,085, filed on Nov. 14, 2014.

(51) Int. Cl.
*H01H 19/14* (2006.01)
*H01H 11/00* (2006.01)
(Continued)

(52) U.S. Cl.
CPC ..... *H01H 19/14* (2013.01); *H01H 11/00* (2013.01); *H01H 19/04* (2013.01);
(Continued)

(58) Field of Classification Search
CPC ..... H01H 19/14; H01H 19/04; H01H 19/20; H01H 11/00; H01H 2221/088; H01H 19/36; H01H 19/40; H01H 19/58
(Continued)

(56) References Cited

U.S. PATENT DOCUMENTS 2,814,679 A 11/1957 Leff et al.
3,159,722 A 12/1964 Cobb et al.
(Continued)

FOREIGN PATENT DOCUMENTS

CN 103219196 A 7/2013
EP 0261778 A1 * 3/1988 ..... H01R 13/111

OTHER PUBLICATIONS

International Search Report and Written Opinion for Application No. PCT/US2015/060528 dated Feb. 1, 2016 (16 pages).
(Continued)

*Primary Examiner* — Anthony R Jimenez
(74) *Attorney, Agent, or Firm* — Andrus Intellectual Property Law, LLP

(57) ABSTRACT

A switch and methods of assembling a switch. The switch may include a housing; a first terminal electrically coupled to a power source; a second terminal electrically coupled to a load; a contact having a first contact end and a second contact end, the contact being operable to be in a closed position, in which the first contact end engages the first terminal and the second contact end engages the second terminal such that the contact electrically connects the first terminal to the second terminal, and an open position, in which the contact does not electrically connect the first terminal and the second terminal; and a biasing member configured to bias the contact towards the first terminal and the second terminal, the biasing member being operable to
(Continued)

apply a first biasing force proximate the first contact end and a second biasing force proximate the second connect end.

21 Claims, 5 Drawing Sheets

(51) Int. Cl.

| | |
|---|---|
| ***H01H 19/04*** | (2006.01) |
| ***H01H 19/20*** | (2006.01) |
| ***H01H 19/11*** | (2006.01) |
| ***H01H 19/36*** | (2006.01) |
| ***H01H 19/40*** | (2006.01) |
| ***H01H 19/58*** | (2006.01) |

(52) U.S. Cl.
CPC ..... *H01H 19/115* (2013.01); *H01H 19/20* (2013.01); *H01H 19/36* (2013.01); *H01H 19/40* (2013.01); *H01H 19/58* (2013.01); *H01H 2221/088* (2013.01)

(58) Field of Classification Search
USPC ..... 200/290
See application file for complete search history.

(56) References Cited

U.S. PATENT DOCUMENTS

| | | | |
|---|---|---|---|
| 4,112,274 | A | 9/1978 | Pigman et al. |
| 4,151,383 | A | 4/1979 | Miyata et al. |
| 4,424,424 | A | 1/1984 | Hallenbeck, Jr. |
| 4,639,612 | A | 1/1987 | Bowman-Jones |
| 5,775,800 | A | 7/1998 | Hsieh |
| 5,923,008 | A | 7/1999 | Williams, Jr. |
| 5,960,939 | A | 10/1999 | Miki et al. |
| 6,175,090 | B1 | 1/2001 | Blossfeld |

OTHER PUBLICATIONS

International Preliminary Report on Patentability for Application No. PCT/US2015/060528 dated May 26, 2017 (14 pages).
Extended European Search Report from the European Patent Office for Application No. 15859664.3 dated May 22, 2018 (13 pages).
First Office Action with English translation from the State Intellectual Property Office of the People's Republic of China for Application No. 201580073088.2 dated Jul. 30, 2018 (30 pages).
Notice of Second Office Action from the Chinese Patent Office for Application No. 201580073088.2 dated Apr. 1, 2019.

* cited by examiner

SINGLE THROW BATTERY SWITCH WITH IMPROVED CONTACT DOME

CROSS-REFERENCE TO RELATED APPLICATION

This application claims priority to U.S. Provisional Patent Application No. 62/080,085, filed Nov. 14, 2014, the entire contents of which are incorporated herein by reference.

FIELD

The invention relates to a battery switch and, more specifically, to a battery switch for a low-voltage, direct-current (DC) electrical system such as a system found on yachts, recreational vehicles, trucks, and other vehicles.

SUMMARY

In vehicle systems, such as, but not limited to, yachts and recreational vehicles, it is advantageous to disconnect electrical power from a bank of batteries (e.g., a DC power supply) to conserve electrical power over an extended period of inactivity. Typically, such DC power supplies are low-voltage (e.g., six-volts, twelve-volts, twenty-four volts, etc.); however, because of the significant power requirements, the DC power supplies may be configured to output a high-current. A battery switch is operable to selectively connect or disconnect the power supply to the vehicle systems.

In one independent embodiment, a switch may generally include a housing; a first terminal supported by the housing and electrically coupled to a power source; a second terminal supported by the housing and electrically coupled to a load; a contact having a first contact end and a second contact end, the contact being operable to be in a closed position, in which the first contact end engages the first terminal and the second contact end engages the second terminal such that the contact electrically connects the first terminal to the second terminal, and an open position, in which the contact does not electrically connect the first terminal and the second terminal; and a biasing member configured to bias the contact towards the first terminal and the second terminal, the biasing member being operable to apply a first biasing force proximate the first contact end and a second biasing force proximate the second connect end.

In another independent embodiment, a switch configured to selectively electrically couple a power source to a load may be provided. The switch may generally include a housing; a first terminal coupled to the housing and electrically coupled to the power source; a second terminal coupled to the housing and electrically coupled to the load; a contact operable to be in a closed position, in which the contact electrically connects the first terminal to the second terminal, and an open position, in which the contact does not electrically connect the first terminal and the second terminal; a biasing member configured to bias the contact towards the first terminal and the second terminal; a rotating member rotatably coupled to the housing defining a cavity configured to receive the biasing member and the contact; and an actuator operably coupled to the rotating member to move the contact between the closed position and the open position.

In yet another independent embodiment, a method of assembly a switch may be provided. The method may generally include providing a housing, a first terminal electrically coupled to a power source, and a second terminal electrically coupled to a load; supporting the first terminal and the second terminal in the housing; providing a contact having a first contact end and a second contact end; supporting the contact for movement between a closed position, in which the first contact end engages the first terminal and the second contact end engages the second terminal such that the contact electrically connects the first terminal to the second terminal, and an open position, in which the contact does not electrically connect the first terminal and the second terminal; and supporting a biasing member to bias the contact towards the first terminal and the second terminal, supporting a biasing member including applying a first biasing force proximate the first contact end and applying a second biasing force proximate the second connect end.

In a further independent embodiment, a method of assembling a switch may be provided, the switch being configured to selectively electrically couple a power source to a load. The method may generally include coupling a first terminal and a second terminal to a first housing, the first terminal being electrically coupled to the power source and the second terminal being electrically coupled to the load; positioning a biasing member and a contact within a cavity of a rotating member; coupling a second housing to the first housing such that the rotating member, the biasing member, and the contact are positioned between the first housing and the second housing, the rotating member, the biasing member, and the contact being rotatable relative to the first housing and the second housing; and attaching an actuator to the rotating member, the actuator being positioned outside the first housing and the second housing, the actuator being operable to selectively move the contact between a closed position, in which the contact electrically connects the first terminal to the second terminal, and an open position, in which the contact does not electrically connect the first terminal and the second terminal.

Other independent aspects of the invention may become apparent by consideration of the detailed description, claims and accompanying drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

Figure 1:
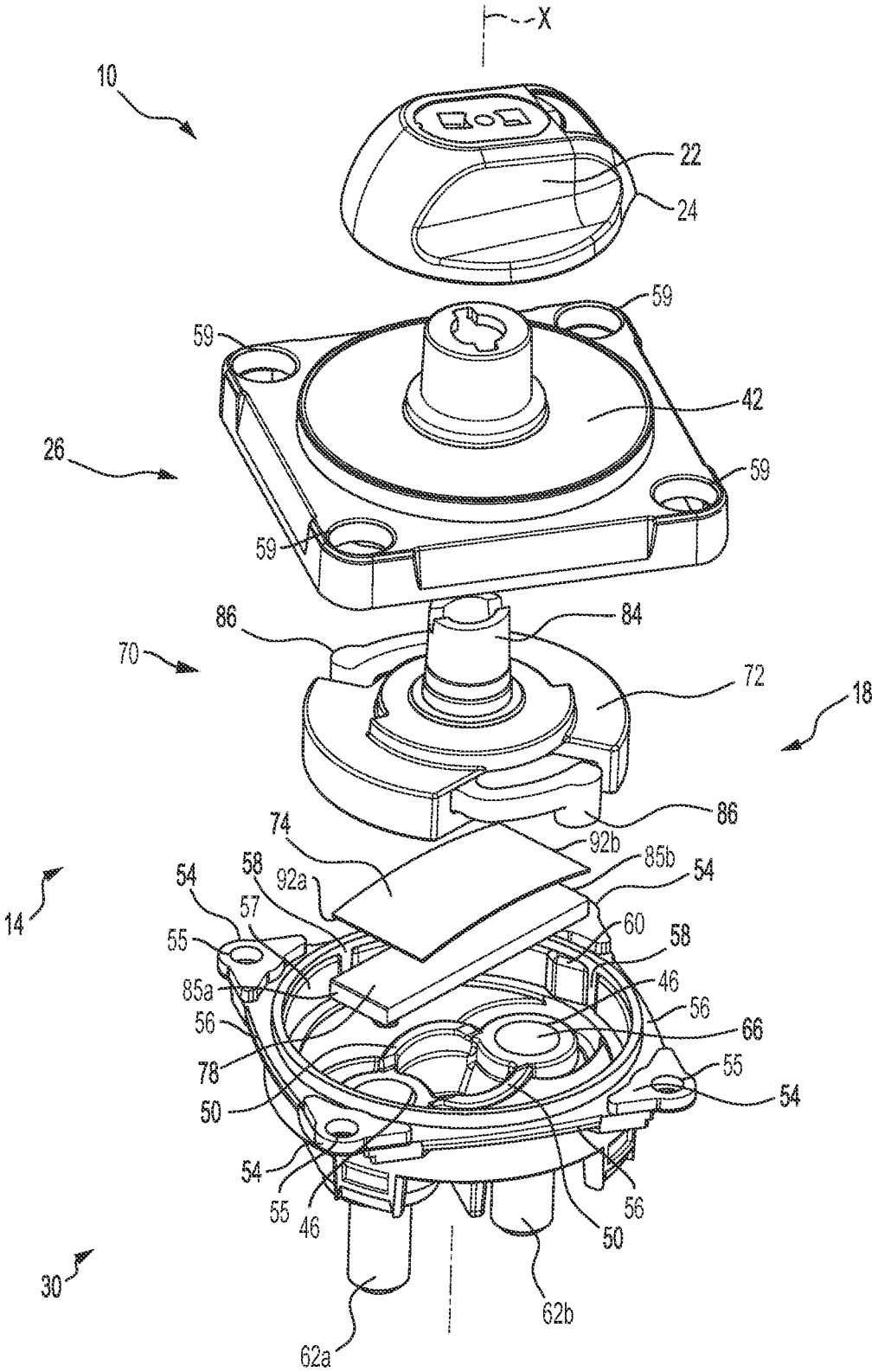
FIG. 1 is an exploded top perspective view of a battery switch.

FIG. 1 illustrates an exploded view of a switch 10 electrically coupled to a power source, such as, but not limited to one or more batteries, and a load to regulate electrical current between the power source and the load. The switch 10 is operable in a closed state, in which electrical current passes through the switch 10, and in an open state, in which the electrical current is inhibited to pass through the switch 10.

The switch 10 includes a housing 14 containing internal components 18 with a rotary selector or actuator knob 22 coupled to the housing 14 and in communication with the internal components 18. The knob 22 rotates about an axis X and includes an indicator 24 indicating an angular position of the knob 22 relative to the housing 14.

Figure 2:
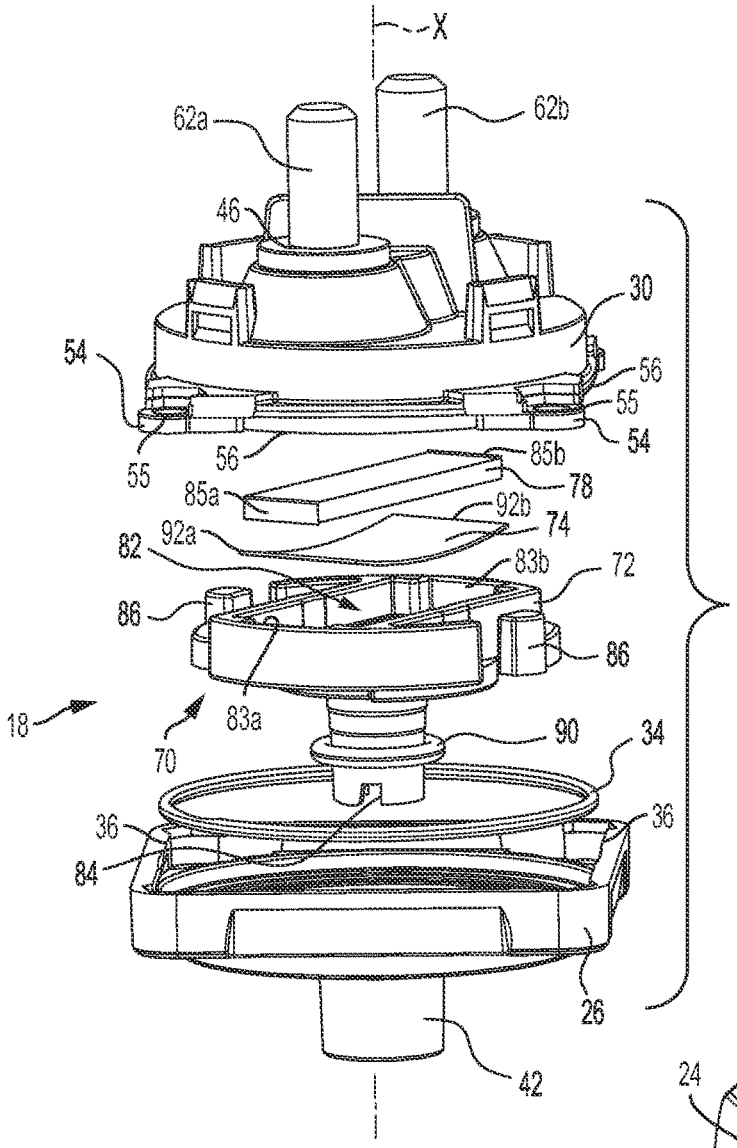
FIG. 2 is an exploded bottom perspective view of the battery switch of FIG. 1.

The housing 14 includes an upper housing 26 located adjacent the knob 22, a lower housing 30 coupled to the upper housing 26, and a gasket 34 (FIG. 2) located between the housings 26, 30 (FIG. 2). The gasket 34 inhibits moisture and debris from propagating into and disrupting the internal components 18. In the illustrated embodiment, the knob 22 is positioned outside of the housings 26, 30. In other words, the knob 22 is located exterior to the housing 14.

Figure 3:
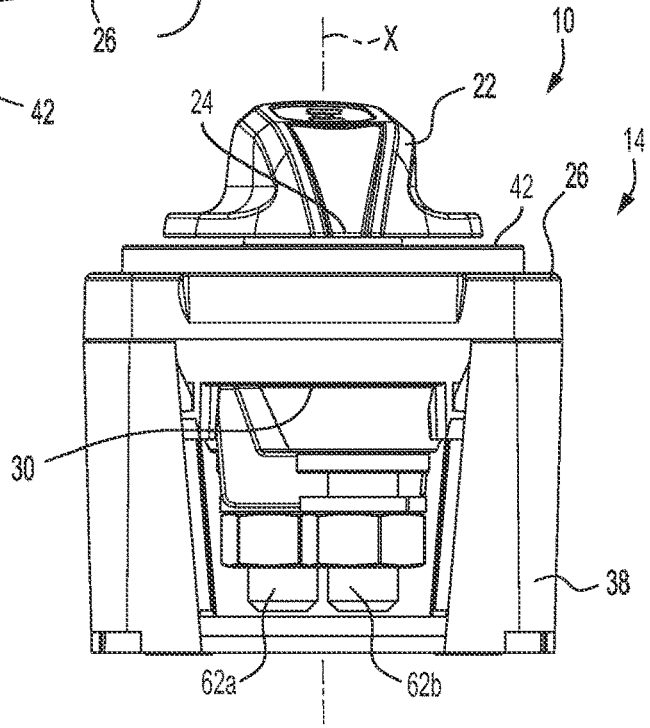
FIG. 3 is a side view of the battery switch of FIG. 1.
Figure 7:
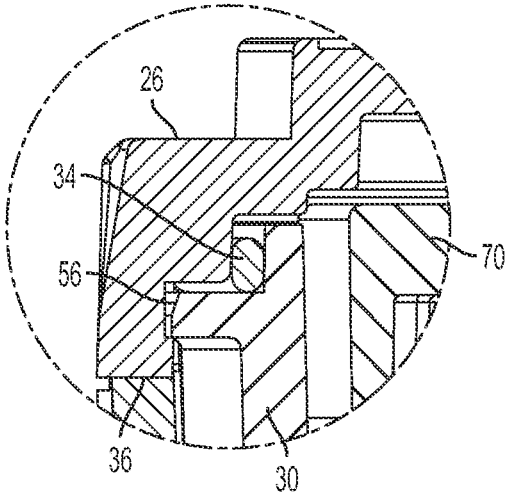
FIG. 7 is a detailed view of a portion of the battery switch taken generally at detail B of FIG. 5.

With reference to FIGS. 2 and 7, the upper housing 26 includes a flange 36 extending towards the axis X and along planar sides of the upper housing 26. As discussed in more detail below, the flange 36 may be configured to couple the housings 26, 30. With reference to FIG. 3, the housing 14 may also include a body 38 extending from and surrounding the lower housing 30. In other embodiments, the upper housing 26 may include indicia (not shown) to be aligned with the indicator 24 of the knob 22 when the switch 10 is in the closed state or the open state.

With reference to FIGS. 1 and 2, the upper housing 26 includes a wheel 42. The wheel 42 rotates about the axis X in a similar fashion as the knob 22. The knob 22 engages the wheel 42 such that the knob 22 and the wheel 42 are non-rotatably coupled while being rotatable together relative to the upper housing 26 (i.e., as a user rotates the knob 22, the wheel 42 is rotated).

Figure 6:
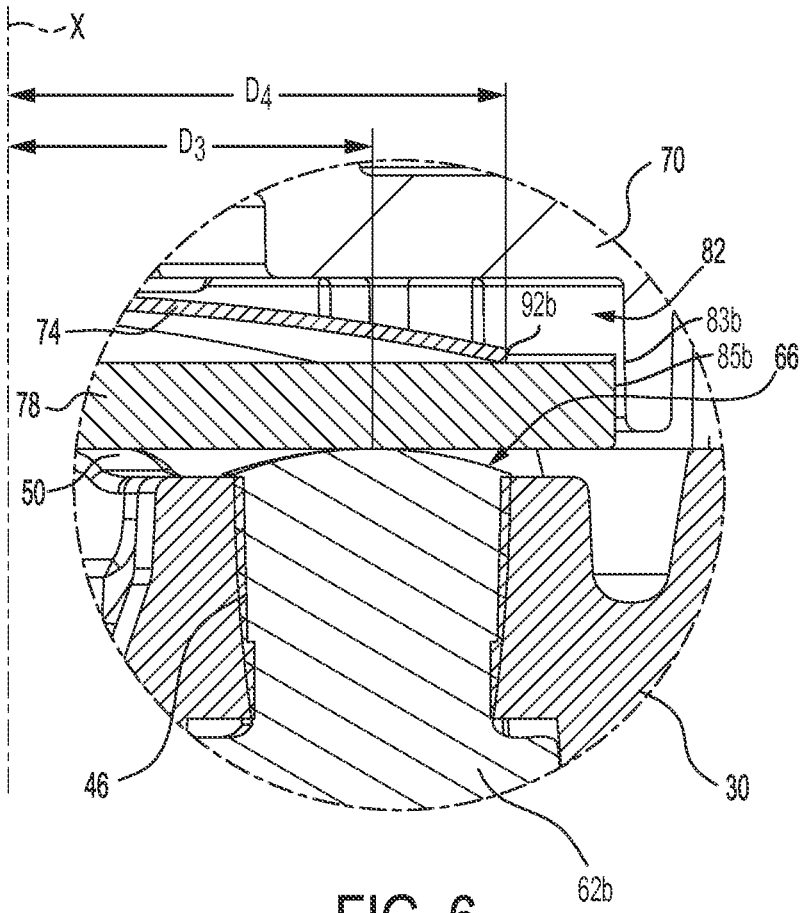
FIG. 6 is a detailed view of a portion of the battery switch taken generally at detail A in FIG. 5.

With reference to FIGS. 1 and 6, the lower housing 30 includes apertures 46 and support features 50 extending between the apertures 46. The support features 50 extend slightly above the apertures 46 towards the upper housing 26 along the axis X. In the illustrated embodiment, the support features 50 are constructed as curvilinear members. In other embodiments, the support features 50 may be differently constructed (e.g., as linear members, combination linear/curvilinear members, etc.).

In addition, the lower housing 30 includes protrusions 54 extending radially outwardly from the axis X and rails 56 connecting adjacent protrusions 54. Each rail 56 engages a corresponding flange 36 (FIG. 7) to couple the housings 26, 30 by an interference fit. In other words, fasteners, adhesives, etc. are not required to couple the housings 26, 30. The protrusions 54 are sized to engage corners of the upper housing 26 with apertures 55 formed through the protrusions 54 aligning with apertures 59 formed through the corners of the upper housing 26, thereby allowing the switch 10 to be fixed to a support structure (not shown) via fasteners.

The lower housing 30 also has a curved wall 57 (FIG. 1) extending about the axis X and defining a cavity of the lower housing 30. The curved wall 57 defines recesses 58 facing inwardly towards the axis X. In the illustrated embodiment, four recesses 58 are spaced apart by ninety degrees relative to each other. In other embodiments (not shown), there may be fewer or more recesses 58 and/or the recesses 58 may be spaced differently relative to each other. In the illustrated embodiment, two opposing recesses 58 are positioned adjacent a stop 60 with the stop 60 projecting towards the axis X (only one stop 60 is shown in FIG. 1; however, the lower housing 30 may include additional stops 60).

The switch 10 also includes terminals 62 secured within the apertures 46 by an interference fit (further illustrated in FIG. 6). The terminals 62 extend away from the lower housing 30 and generally parallel to the axis X (FIG. 2). In other embodiments, the terminals 62 may extend in a different direction (e.g., generally perpendicular to the axis X). In the illustrated configuration as a battery switch, the terminals 62 are electrically couplable to electrically couple the power source to the load through the switch 10.

With reference to FIG. 2, the internal components 18 include a rotating member 70 having a rotating member body 72, a biasing member 74, and a contact 78. The biasing member 74 and the contact 78 are received in a cavity 82 of the rotating member body 72 with the cavity 82 in a facing relationship with the terminals 62. In particular, the cavity 82 includes opposing channels 83 that are sized to receive ends 85 of the contact 78. In other words, the channels 83 receive a portion of a perimeter of the contact 78. The engagement between the ends 85 of the contact 78 and the channels 83 enables the contact 78 to rotate with the rotating member 70 about the axis X while allowing the contact 78 to axial move relative to the rotating member 70 parallel to the axis X. In other embodiments (not shown), the contact 78 may be fixedly coupled within the cavity 82, and the rotating member 70 may rotate about and move axially relative to the axis X. The rotating member 70 is coupled to the knob 22 via a connection feature 84 of the rotating member 70 such that the rotating member 70, the biasing member 74, and the contact 78 rotate together with the rotation of the knob 22.

The rotating member body 72 further includes resilient fingers 86 located on an outer circumference of a portion of the rotating member 70. In the illustrated embodiment, there are two resilient fingers 86; however, in other embodiments (not shown), there may be only one or more than two resilient fingers 86. Each finger 86 is biased in a direction generally perpendicular to the axis X to selectively engage a corresponding recess 58 in the lower housing 30 to provide a detent arrangement. A gasket 90 is located between the upper housing 26 and the rotating member 70 to inhibit moisture and debris from propagating into and disrupting the internal components 18.

In some embodiments, the contact 78 is constructed from bar stock material with a cuboid cross section, e.g., a rectangular cross section. As described in more detail below, the length of the contact 78 is such that, in the closed state, the contact 78 will be in direct contact with both terminals 62. The contact 78 may also be constructed from a material having adequate electrical conductivity properties, such as but not limited to, silver, gold, copper, etc.

Additionally, the contact 78 may be coated (e.g., electroplated) with a material having electrical conductivity properties. In some embodiments, the coating may have a higher electrical conductivity than the material being coated. For example, a rectangular bar stock of steel may be coated with copper to obtain a desired electrical conductivity.

The biasing member 74 is generally located between the contact 78 and the rotating member body 72 and is configured to force the contact 78 against the terminals 62, thereby reducing electrical resistance therebetween. With reference to FIG. 6, in some embodiments, the terminals 62 include a convex surface 66 adjacent the support features 50. In particular, the support features 50 are positioned above the convex surfaces 66. The convex surfaces 66 facing the contact 78 may, for example, allow for lower contact resistance between the terminals 62 and the contact 78, provide more thermal mass and heat sinking into cables (not shown) coupling the bank of batteries to the switch 10, etc.

In the illustrated embodiment, the biasing member 74 includes a leaf spring which biases the contact 78 away from the rotating member 70 along the axis X. The biasing member 74 may engage the contact 78 at one or more points. In the illustrated embodiment, the center of the biasing member engages the rotating member 72, and the opposite ends 92*a*, 92*b* of the biasing member 74 engage at or proximate the respective ends 85*a*, 85*b* of the contact 78 that generally align with the convex surfaces 66 of the terminals 62*a*, 62*b* (FIG. 6). As a result, the biasing member 74 provides maximum biasing force against the contact 78 towards the respective terminal 62*a*, 62*b* to ensure adequate contact area therebetween.

The illustrated biasing member 74 is operable to apply a biasing force proximate each end 85*a*, 85*b* of the contact 78. The first contact end 85*a* is engageable with the first terminal 62*a* (e.g., at the apex of the convex surface 66) at a radial distance $D_1$ from the axis X, and the first end 92*a* of the biasing member 74 applies the biasing force to the first contact end 85*a* at a radial distance $D_2$ greater than the radial distance $D_1$. Similarly, the second contact end 85*b* is engageable with the second terminal 62*b* at a radial distance $D_3$ from the axis, and the second end 92*b* the biasing member 74 applies the biasing force to the second contact end 85*b* at a radial distance $D_4$ greater than the radial distance $D_3$.

In the illustrated construction, the radial distance between the axis X and the engagement of the contact ends 85*a*, 85*b* with the respective terminals 62*a*, 62*b* is approximately the same. Similarly, the radial distance between the axis X and the engagement of the biasing member ends 92*a*, 92*b* and the contact 78 is approximately the same. In the illustrated construction, the biasing force applied by the end 92*a* to the contact 78 is approximately the same as the biasing force applied by the end 92*b* to the contact 78.

In another embodiment (not shown), the biasing member 74 may be positioned in a manner such that a center of the biasing member 74 engages a center of the contact 78, while the opposite ends 92 of the biasing member 78 engage with the rotating member 72. In other embodiments (not shown), the biasing member 74 may include other mechanisms, in addition or as an alternative to the leaf spring, to bias the contact 78 away from the rotating member 70/towards the terminals 62. For example, the biasing member 74 may include a Belleville washer, wave spring, or the like. In addition, more than one biasing member may be positioned between the contact 78 and the rotating member 70.

To assemble the switch 10, the biasing member 74 is first positioned within the cavity 82, and then the ends 85*a*, 85*b* of the contact 78 are received within the corresponding channel 83*a*, 83*b*. In the illustrated embodiment, the biasing member 74 includes a greater width and a shorter length than the contact 78 such that the biasing member 74 is received within the cavity 82 but is not engaged by the channels 83*a*, 83*b*.

The rotating member body 72 is received within the cavity defined by the curved wall 57 (FIG. 1) of the lower housing 30 such that the resilient fingers 86 engage corresponding recesses 58. As a result of the stops 60 positioned adjacent two opposing recesses 58, the rotating member 70 is limited in rotational movement relative to the lower housing 30 when the resilient fingers 86 abut the stops 60. Thus, in some embodiments, the knob 22 is pivotable in a limited operational range (e.g., of about ninety degrees) between the closed state and the open state.

Once the rotating member 70 is coupled to the lower housing 20, the contact 78 is forced against the convex surface 66 of both terminals 62 via the biasing member 74. The upper housing 26 is coupled to the lower housing 30 via the interference fit provided by the protrusions 54 and the engagement between the flange 36 and the rails 56. As the upper housing 26 is coupled to the lower housing 30, the connection feature 84 of the rotating member 70 is received in a portion of the wheel 42. Consequently, the knob 22 engages the wheel 42 and the rotating member 70 so that the knob 22, the wheel 42, and the rotating member 70 rotate together.

In some embodiments, the knob 22 is removable from the wheel 42 for disassembly of the switch 10. In such an embodiment, to remove the knob 22 from the wheel 42, the knob 22 is rotated past the operational range (e.g., to about one hundred degrees). The wheel 42 will remain stationary due to engagement between the rotating member 70 and the stops 60, while the knob 22 continues to pivot and disengage from the wheel 42.

Figure 4:
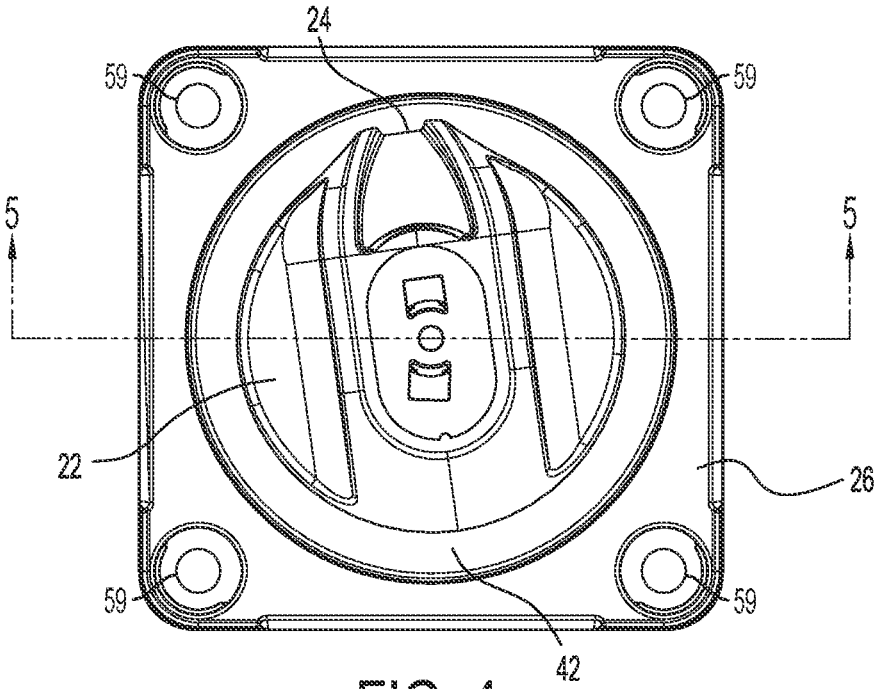
FIG. 4 is a top view of the battery switch of FIG. 1 illustrated in a closed state enabling electrical current to flow through the battery switch.
Figure 5:
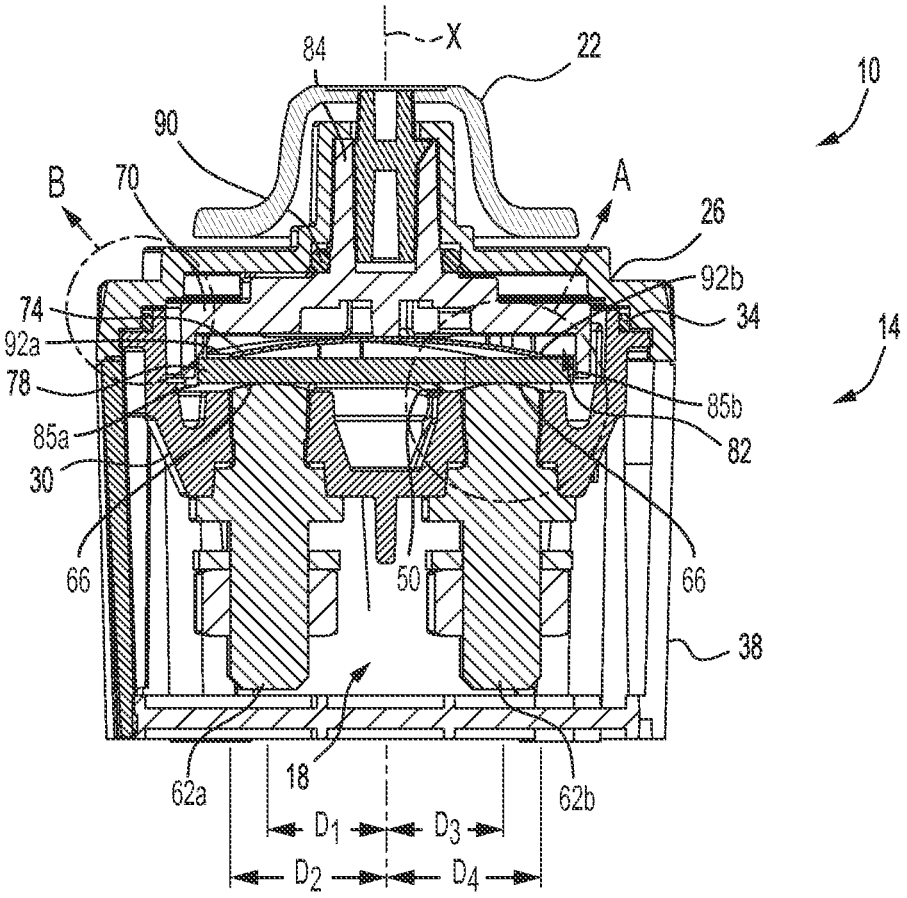
FIG. 5 is a cross-sectional view of the battery switch taken generally along line 5-5 in FIG. 4.
Figure 8:
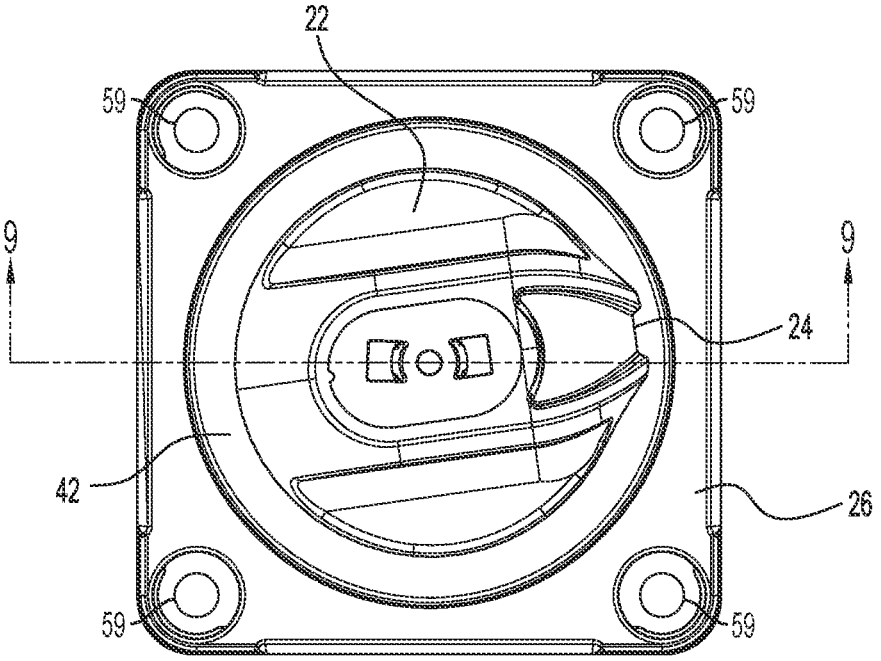
FIG. 8 is a top view of the battery switch of FIG. 1 illustrated in an open state disabling electrical current to flow through the battery switch.

In operation, the knob 22 is pivoted between a closed position (FIG. 4) and an open position (FIG. 8) corresponding to the closed state and the open state of the switch 10. In the closed state, the contact 78 directly engages the convex surfaces 66 of the terminals 62 to allow current flow from one terminal 62 to the other terminal 62 via the contact 78 (FIGS. 5 and 6). In the closed position, the biasing member 74 forces the contact 78 into engagement with the terminals 62. Additionally, in the closed position, each resilient finger 86 moves into an associated recess 58, providing positive engagement between the rotating member 70 and the lower housing 30. The positive engagement indicates that the switch 10 is fully oriented in the closed state by temporarily holding the rotating member 70 relative to the lower housing 30.

Figure 9:
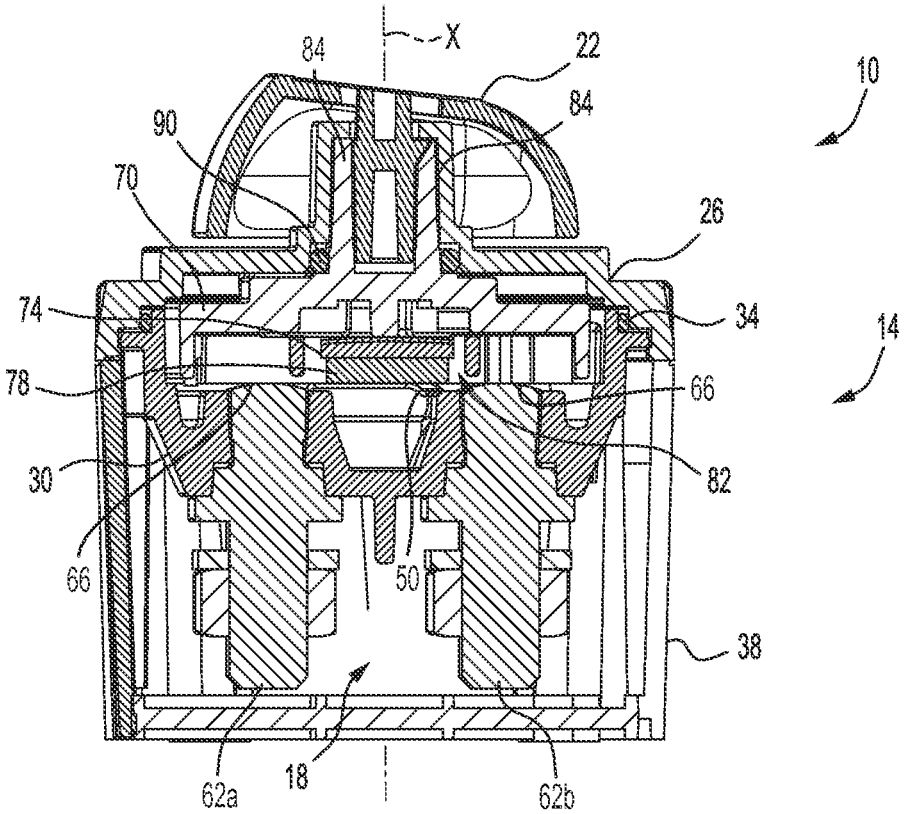
FIG. 9 is a cross-sectional view of the battery switch taken generally along line 9-9 in FIG. 8.

When the open state is desired, the knob 22 is pivoted through the operational range (e.g., about ninety degrees) such that the contact 78 disengages both terminals 62 and directly contacts the support features 50 (FIG. 9). At the same time, each resilient finger 86 moves into an associated recess 58, providing positive engagement between the rotating member 70 and the lower housing 30. The positive engagement indicates that the switch 10 is fully oriented in the open state by temporarily holding the rotating member 70 relative to the lower housing 30. To return to the closed state, the knob 22 is rotated in the opposite direction through the operational range (e.g., again, about ninety degrees) to reestablish engagement between the terminals 62 and the contact 78.

Thus, the invention may provide a switch with a biasing member which applies a biasing force proximate each engagement of a contact and a terminal. Also, the invention may provide a simple process of coupling the biasing member 74 and the contact 78 to the rotating member 70 between two housing members 26, 30 without the use of fasteners.

One or more independent features and/or independent advantages of the invention may be set forth in the claims.

What is claimed is:

1. A switch comprising:

a housing;

a first terminal supported by the housing and electrically coupled to a power source;

a second terminal supported by the housing and electrically coupled to a load;

a contact having a first contact end and a second contact end, the contact being operable to be in a closed position, in which the first contact end engages the first terminal and the second contact end engages the second terminal such that the contact electrically connects the first terminal to the second terminal, and an open position, in which the contact does not electrically connect the first terminal and the second terminal; and a biasing member including a first end and a second end configured to bias the first contact end towards the first terminal by applying a first biasing force proximate the first contact end via the first end and bias the second contact end towards the second terminal by applying a second biasing force proximate the second contact end via the second end;

wherein the contact and the biasing member are configured to rotate about a common axis that extends longitudinally through the contact and the biasing member.

2. The switch of claim 1, further comprising:

a rotating member rotatably coupled to the housing, the rotating member including a cavity configured to receive the biasing member and the contact; and an actuator operably coupled to the rotating member to move the contact between the closed position and the open position.

3. The switch of claim 1, wherein the first biasing force is substantially the same as the second biasing force.

4. The switch of claim 1, wherein the biasing member includes a leaf spring.

5. The switch of claim 4, wherein the leaf spring has a first end engaging and applying the first biasing force to the first contact end and a second end engaging and applying the second biasing force to the second contact end.

6. The switch of claim 1, wherein the first terminal and second terminal each have a convex surface engageable with the contact.

7. The switch of claim 6, wherein the contact is pivotable about an axis between the closed position and the open position, wherein the first terminal has an apex, and wherein the first biasing force is applied to the first contact end radially beyond the apex.

8. The switch of claim 7, wherein the second terminal has a second apex, and wherein the second biasing force is applied to the second contact end radially beyond the second apex.

9. The switch of claim 1, wherein the contact is pivotable about an axis between the closed position and the open position.

10. The switch of claim 9, wherein the contact extends radially, wherein the first contact end is engageable with the first terminal at a first radial distance from the axis, and wherein the biasing member applies the first biasing force to the first contact end at a second radial distance greater than the first radial distance.

11. The switch of claim 10, wherein the second contact end is engageable with the second terminal at a third radial distance from the axis, and wherein the biasing member applies the second biasing force to the second contact end at a fourth radial distance greater than the third radial distance.

12. The switch of claim 11, wherein the first radial distance is substantially the same as the third radial distance.

13. The switch of claim 12, wherein the second radial distance is substantially the same as the fourth radial distance.

14. The switch of claim 9, wherein the biasing member extends radially between the first end, engaging and applying the first biasing force to the first contact end, and the second end, engaging and applying the second biasing force to the second contact end.

15. The switch of claim 14, wherein the first contact end is engageable with the first terminal at a first radial distance from the axis, and wherein the first end engages the first contact end at a second radial distance greater than the first radial distance.

16. The switch of claim 15, wherein the second contact end is engageable with the second terminal at a third radial distance from the axis, and wherein the second end engages the second contact end at a fourth radial distance greater than the third radial distance.

17. The switch of claim 16, wherein the first radial distance is substantially the same as the third radial distance.

18. The switch of claim 17, wherein the second radial distance is substantially the same as the fourth radial distance.

19. A method of assembling a switch, the switch being configured to selectively electrically couple a power source to a load, the method comprising:

coupling a first terminal and a second terminal to a first housing, the first terminal being electrically coupled to the power source and the second terminal being electrically coupled to the load;

positioning a biasing member and a contact within a cavity of a rotating member;

coupling a second housing to the first housing such that the rotating member, the biasing member, and the contact are positioned between the first housing and the second housing, the rotating member, the biasing member, and the contact being rotatable relative to the first housing and the second housing;

attaching an actuator to the rotating member, the actuator being positioned outside the first housing and the second housing, the actuator being operable to selectively move the contact between a closed position, in which the contact electrically connects the first terminal to the second terminal, and an open position, in which the contact does not electrically connect the first terminal and the second terminal, wherein the contact has a first contact end and a second contact end and the bias member has a first end and a second end, and wherein positioning the biasing member includes positioning the biasing member to apply a first biasing force proximate the first contact end via the first end and to apply a second biasing force proximate the second contact end via the second end; and wherein the contact and the biasing member are configured to rotate about a common axis that extends longitudinally through the contact and the biasing member.

20. The method of claim 19, wherein positioning the biasing member within the cavity includes positioning a leaf spring within the cavity to bias the contact towards the first terminal and the second terminal.

21. The method of claim 19, wherein positioning the contact within the cavity includes positioning a cuboid-shaped contact within the cavity.

* * * * *